US005251829A

United States Patent [19]

Lesar

[11] Patent Number: 5,251,829

[45] Date of Patent: Oct. 12, 1993

[54] BONE COLLECTOR ASSEMBLY FOR A MEAT GRINDER

[75] Inventor: Nick J. Lesar, Palmyra, Wis.

[73] Assignee: Weiler and Company, Inc., Whitewater, Wis.

[21] Appl. No.: 654,942

[22] Filed: Feb. 13, 1991

[51] Int. Cl.[5] ..... B02C 23/02

[52] U.S. Cl. ..... 241/30; 241/82.2; 241/82.3; 241/82.4; 241/82.6

[58] Field of Search ..... 241/30, 82.1–82.7

[56] References Cited

U.S. PATENT DOCUMENTS

| | | |
|---|---|---|
| 737,783 | 9/1903 | Schyia . |
| 1,514,271 | 11/1924 | Tilden . |
| 2,166,197 | 7/1939 | Schaub . |
| 2,640,033 | 5/1953 | Marshall . |
| 3,340,917 | 9/1967 | Vedvik . |
| 3,739,994 | 6/1973 | McFarland . |
| 3,762,658 | 10/1973 | Barnes . |
| 3,847,360 | 11/1974 | Seydelmann . |
| 3,917,178 | 11/1975 | Barnes . |
| 3,934,827 | 1/1976 | Seydelmann . |
| 4,004,742 | 1/1977 | Hess . |
| 4,014,075 | 3/1977 | van Bergen . |
| 4,141,113 | 2/1979 | van Bergen . |
| 4,153,208 | 5/1979 | Vomhof et al. . |
| 4,189,104 | 2/1980 | dos Santos . |
| 4,202,502 | 5/1980 | Laska . |
| 4,358,061 | 11/1982 | Richter . |
| 4,422,582 | 12/1983 | Roeger et al. . |
| 4,536,920 | 8/1985 | Amersfoort . |
| 4,613,085 | 9/1986 | Simonsen . |
| 4,699,325 | 10/1987 | Hess . |
| 4,700,899 | 10/1987 | Powers et al. . |
| 4,795,104 | 1/1989 | Budibaugh . |
| 4,928,892 | 5/1980 | Huebner et al. . |

FOREIGN PATENT DOCUMENTS

| | | | |
|---|---|---|---|
| 197056 | 5/1907 | Fed. Rep. of Germany | 241/82.5 |
| 587177 | 4/1932 | Fed. Rep. of Germany . | |
| 2809609 | 9/1979 | Fed. Rep. of Germany . | |
| 3820316 | 12/1989 | Fed. Rep. of Germany . | |
| 2242151 | 3/1975 | France . | |
| 428436 | 12/1947 | Italy | 241/82.7 |
| 1250325 | 8/1986 | U.S.S.R. | 241/82.5 |
| 3715322 | 8/1986 | U.S.S.R. | 241/82.5 |
| 1386299 | 4/1988 | U.S.S.R. | 241/82.5 |
| 726754 | 3/1955 | United Kingdom | 241/82.1 |

*Primary Examiner*—Mark Rosenbaum
*Assistant Examiner*—Frances Chin
*Attorney, Agent, or Firm*—Andrus, Sceales, Starke & Sawall

[57] ABSTRACT

A meat grinding assembly incorporating several features which enhance the ability of the assembly to collect hard material such as bone, gristle, sinew or the like, to prevent such material from being ground along with the meat. The grinder includes an orifice provided at the end of a tubular housing, with a rotating knife assembly located against the inner surface of the orifice plate. The orifice plate include a series of radially spaced large collection openings, each of which is provided with an outwardly extending ramped entryway. The entryways into the collection openings facilitate passage of the hard material thereinto. The knife assembly includes a series of knife holding arms which extend outwardly from a hub, with the arms being oriented non-radially to the hub. The knife arms are angled forwardly, so as to facilitate passage of material toward the hub during rotation of the knife assembly. The hub includes as series of collection pockets located forwardly of the knife arms, which cooperate with the ramped entryways to the collection openings to pass hard material into the collection openings. An improved structure is provided for mounting the knives to the knife arms. The clearance between the inner surface of the orifice plate and the end of the pressure flighting of a feed screw located in the housing can be adjusted, to accommodate light or heavy hard material conditions. A recovery grinding assembly is provided for grinding soft material which may pass through the collection openings along with the hard material.

48 Claims, 5 Drawing Sheets

FIG. 2
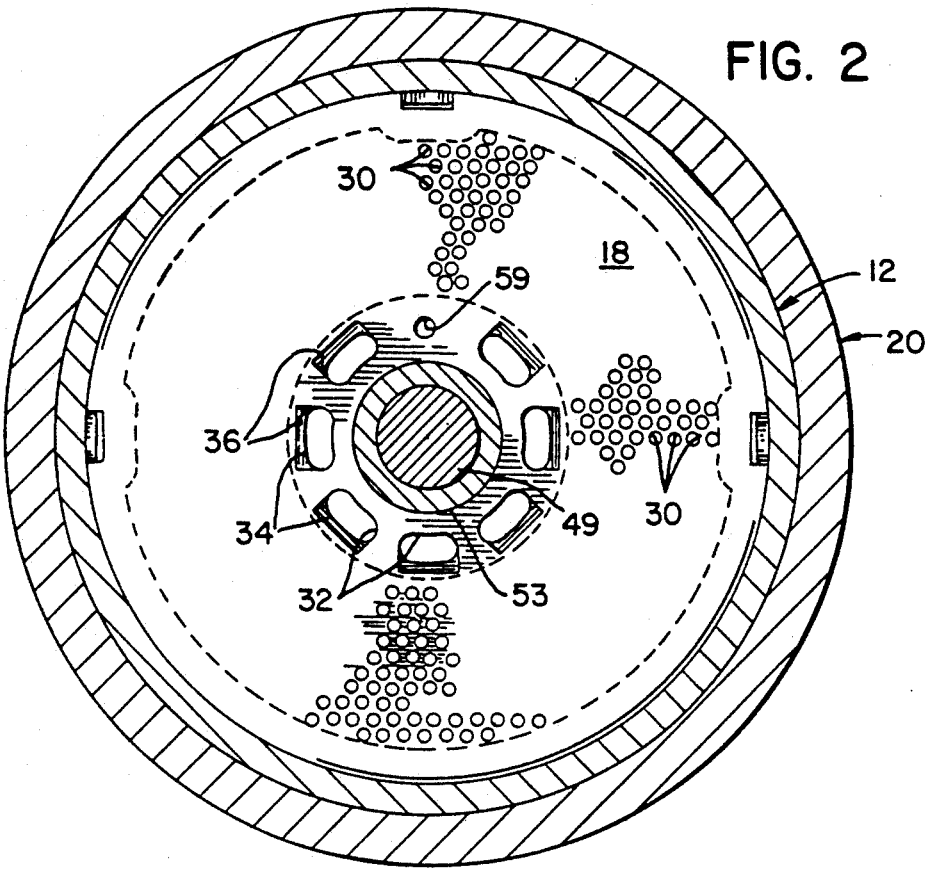
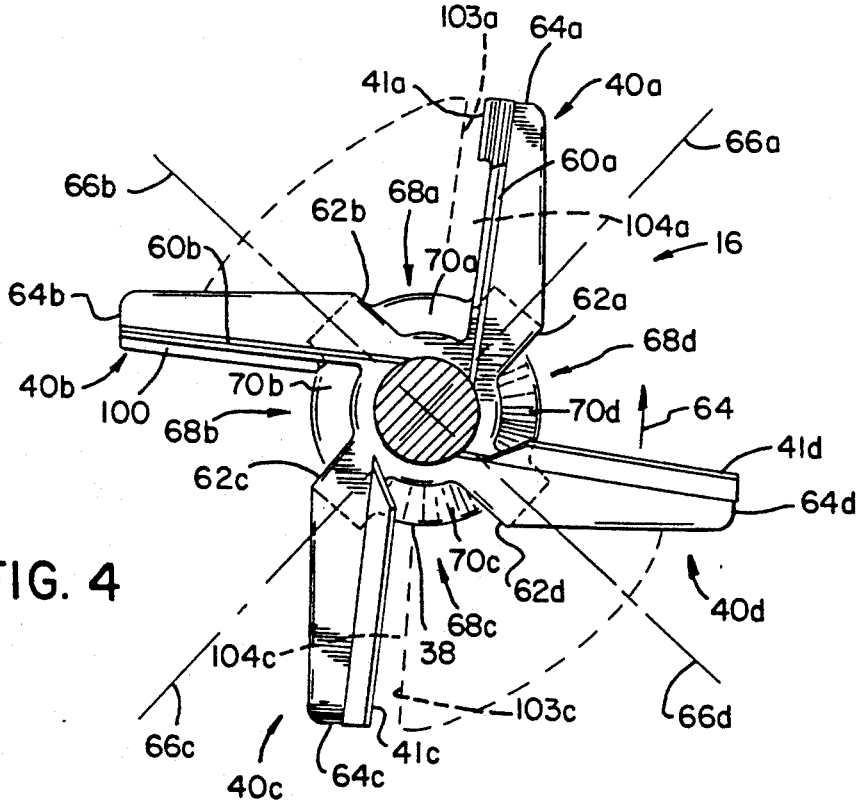
FIG. 4

BONE COLLECTOR ASSEMBLY FOR A MEAT GRINDER

BACKGROUND AND SUMMARY

This invention relates to a grinder such as for use in grinding meat, and more particularly to features for use with a meat grinder which facilitate removal of hard material such as bone, sinew or gristle so that such materials are not ground along with the meat.

In high volume production of ground meat, it is common for the meat being ground to contain hard materials such as bone, sinew, gristle or the like. It is desirable to remove such material prior to or during grinding of the meat, to ensure that the hard material is not ground along with the meat.

A meat grinder typically includes an orifice plate located at the open end of a tubular housing, and a rotating knife assembly provides a series of knives disposed against a surface of the orifice plate. The knives are mounted to a knife holder, which typically comprises a series of radial arms extending outwardly from a central hub. To remove hard material during grinding, it has been known to provide a series of collection orifices toward the central portion of the orifice plate. With a system of this type, rotation of the knife assembly moves the hard material around the orifice plate, with the hard material eventually making its way toward the center of the orifice plate, where it is received into one of the collection orifices.

A system such as that summarized above generally works satisfactorily to remove hard material from meat during grinding of the meat. However, it has been found that with a lower grade of meat being ground, which contains a greater amount of hard material than higher grade meat, it is nearly impossible for such a system to remove substantially all of the hard material during grinding of the meat.

Accordingly, the present invention has as its object to provide a hard material collection system for use with a meat grinder, which enhances the ability of the grinder to collect hard material during grinding of the meat. It is a further object of the invention to provide a hard material collection system which is used in connection with a conventional grinding system, in which a feed screw advances the meat through a housing toward an orifice plate, and in which a rotating knife assembly is disposed toward the end of the feed screw against the inner surface of the orifice plate. It is further an object of the invention to provide a hard material collection system which is relatively simple in design and in installation, yet which provides a greatly increased ability to collect hard material prior to passing of the hard material through the meat grinding orifices of the orifice plate.

In accordance with one aspect of the invention, a series of spaced collection openings or passages are located toward the center of the orifice plate for collecting hard material such as bone, gristle, sinew or the like. Each collection opening includes a ramped entryway opening onto the surface of the orifice plate facing the knife assembly. The collection openings are relatively large openings, and are located inwardly of relatively small outer openings through which the soft material passes. The ramped entryway to each collection opening extends outwardly toward the outer openings. The collection openings are preferably oval or kidney shaped in plan, and the ramped entryways extend outwardly along one of the long sides of each collection opening. The ramped entryways assist in feeding hard material into the collection openings, and also cooperate with the ends of the collection openings to define shearing edges. When a piece of hard material which is larger than the collection opening is directed into one of the collection openings by the ramped entryway associated therewith, the hard material lodges in the collection opening. Movement of the knife assembly over the collection opening shears off the hard material against the shearing edge defined by the ramped entryway in combination with the end of the collection opening. The portion of the piece of the hard material within the collection opening thereafter passes through the collection opening, and the portion which is sheared off is directed into another collection opening for repeated shearing until it is of a size small enough to pass through a collection opening.

In accordance with another aspect of the invention, the rotating knife assembly includes a central hub and a plurality of knife holding arms extending outwardly from the hub, with a knife mounted to each knife holding arm. The arms are arranged so as to be non-radial relative to the hub, thereby providing non-radial mounting of the knives. This arrangement facilitates movement of the hard material inwardly toward the hub during rotation of the knife assembly. In a preferred embodiment, the hub is provided with a collection pocket forwardly of each knife holding arm for receiving hard material moved inwardly toward the hub during rotation of the knife assembly. The collection pockets on the hub are preferably located in alignment with the collection openings in the orifice plate. The collection openings preferably include ramped entryways as described above for facilitating entry of hard material into the collection openings. Each collection pocket preferably includes an outwardly facing ramped area provided on the hub forwardly of each knife holding arm. In a preferred arrangement, each arm includes a base connected to the hub and an outer end spaced outwardly from the base. Each arm is arranged such that its longitudinal axis is non-parallel to a line extending through its base and through the center of the hub. In this manner, the longitudinal axis of each arm is tangential to a circle concentric with the center of the hub. In a particularly preferred arrangement, the longitudinal axis of each arm is tangential to a common circle concentric with the center of the hub. In one embodiment, the arms are arranged such that the longitudinal axis of each arm is substantially perpendicular to the longitudinal axes of its adjacent arms.

In accordance with yet another aspect of the invention, the knife holder includes a hub and a plurality of knife holding arms extending outwardly therefrom, with a substantially central passage formed in the hub and adapted to receive a centering shaft therethrough. Each knife holding arm has a forwardly opening knife mounting slot formed therein, with each slot opening into the central passage in the hub. A knife mounting pin extends transversely through each knife mounting slot, and is located toward the outer end of each knife holding arm. Each knife is provided with an outwardly opening pin-receiving slot adapted to receive the knife mounting pin therein, wherein the centering shaft and the knife mounting pins cooperate to maintain the knives in position within the slots. This mounting structure acts to positively retain the knives in the knife holder once the centering shaft is inserted through the central passage formed in the hub.

In accordance with a further aspect of the invention, a recovery grinding arrangement is provided downstream of the orifice plate. The recovery grinding arrangement recovers and grinds any soft material which may have passed through the collection openings along with the hard material. The recovery grinding arrangement includes a housing having a rotating recovery knife assembly located within its interior. Material passing through the collection openings is routed to the interior of the housing. In one embodiment, a secondary orifice plate is mounted to the end of the housing, and the soft material is forced by the rotating knife assembly through orifices formed therein. The recovered soft material is then mixed with the ground soft material discharged from the primary orifice plate. In another embodiment, a series of orifices are formed in an upper side wall of the housing. The rotating knife assembly forces the recovered soft material upwardly through the orifices, where it mixes with the soft material discharged from the primary orifice plate. In both embodiments, a discharge tube is connected at the outer end of the housing, and includes an internal passage in communication with the interior of the housing. The hard material is routed by the rotating knife assembly to the internal passage of the discharge tube. A secondary auger is connected to the rotating knife assembly, and is disposed within the internal passage of the discharge tube for passing the hard material therethrough.

In a particularly preferred embodiment of the invention, the various aspects and features as summarized above are combined into a single structure for facilitating advancing of hard material toward the center of the orifice plate during grinding and passage of the hard material into the collection openings formed in the orifice plate, and for recovering soft material which may pass through the collection openings along with the hard material.

Various other features, advantages and objects of the invention will be made apparent from the following description taken together with the drawings.

BRIEF DESCRIPTION OF THE DRAWINGS

The drawings illustrate the best mode presently contemplated of carrying out the invention.

In the drawings:

FIG. 2 is a sectional view taken generally along line 2—2 of FIG. 1;

FIG. 4 is an end elevation view showing the knife holder assembly of the invention, reference being made to line 4—4 of FIG. 1;

DETAILED DESCRIPTION OF THE PREFERRED EMBODIMENT

Figures 1, 3:
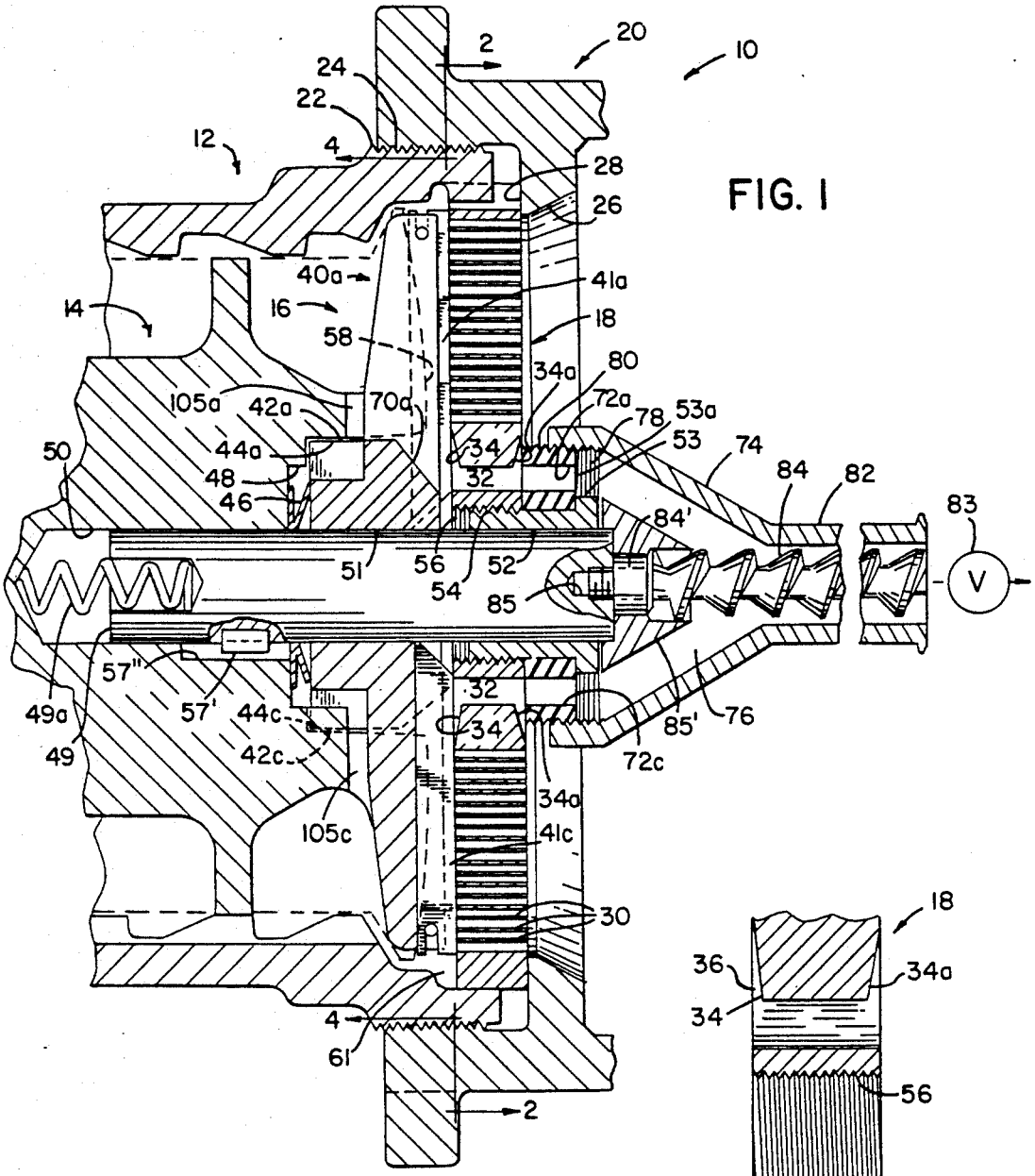
FIG. 1 is a partial cross-sectional view through the grinding head of a meat grinding machine, showing the features of the invention incorporated therein.
FIG. 3 is an enlarged partial sectional view showing the central portion of the orifice plate, with the collection openings extending therethrough.

FIG. 1 illustrates the grinding head 10 of a meat grinder, which includes a tubular housing 12 within which a feed screw 14 is rotatably mounted. Housing 12 and feed screw 14 are generally constructed as is known in the art so that, upon rotation of feed screw 14 within housing 12, meat or the like is advanced within the interior of housing 12 toward grinding head 10.

A knife assembly, shown generally at 16, is mounted at the end of the feed screw 14. Knife assembly 16 is disposed against the inner surface of an orifice plate, generally shown at 18, which is secured in the open end of housing 12 by a mounting ring, shown generally at 20. In accordance with known construction, the end of housing 12 is provided with a series of external threads 22, and mounting ring 20 includes a series of internal threads 24, adapted to engage external threads 22 on housing 12. Mounting ring 20 further includes an opening 26 defining an inner lip 28, which is adapted to engage the outer peripheral portion of orifice plate 18 to maintain orifice plate 18 in position within the open end of housing 12.

Referring to FIGS. 1 and 2, orifice plate 18 is provided with a large number of relatively small grinding openings therethrough, such as shown at 30. The size of outer openings 30 varies according to the type of meat being ground. Generally, however, grinding openings 30 range from 3/32 inch to ½ inch in diameter. In accordance with known grinding principles, meat within the interior of housing 12 is forced toward orifice plate 18 by rotation of feed screw 14 and through openings 30, with rotating knife assembly 16 acting to sever the meat against the inner surface of orifice plate 18 prior to the meat passing through openings 30 in orifice plate 18.

As is also shown in FIGS. 1 and 2, a series of relatively large inner collection openings or passages 32 are formed in orifice plate 18 inwardly of the outer grinding openings 30. Collection openings 32 are located at a common radius from the center of orifice plate 18, and are equally radially spaced from each other. Collection openings 32 are generally oval or slightly kidney-shaped. Illustratively, collection openings 32 are approximately one inch long and three-eighths of an inch wide. As will be explained, collection openings 32 act to collect bone, gristle, sinew or other hard material prior to its passing through grinding openings 30 in orifice plate 18 during operation of grinding head 10.

Each of collection openings 32 is provided with a ramped entryway 34 opening onto the inner surface of orifice plate 18. Ramped entryways 34 are disposed at an angle of approximately 8 degrees to the surface of orifice plate 18, and extend outwardly from collection openings 32 in a direction toward the outer grinding openings 30. In a preferred embodiment, both the inner and outer surfaces of orifice plate 18 are provided with ramped entryways 34 leading into collection orifices 32. This arrangement accommodates mounting of orifice plate 18 at the end of housing 12 such that either of its surfaces can be employed as the inner cutting surface against knife assembly 16. In FIG. 1, the ramped entryways formed in the outer surface of orifice plate 18 are shown at 34*a*.

The end walls formed by each of the ramped entryways 34 provide shearing surfaces such as shown at 36, the purpose of which will later be explained.

Figure 5:
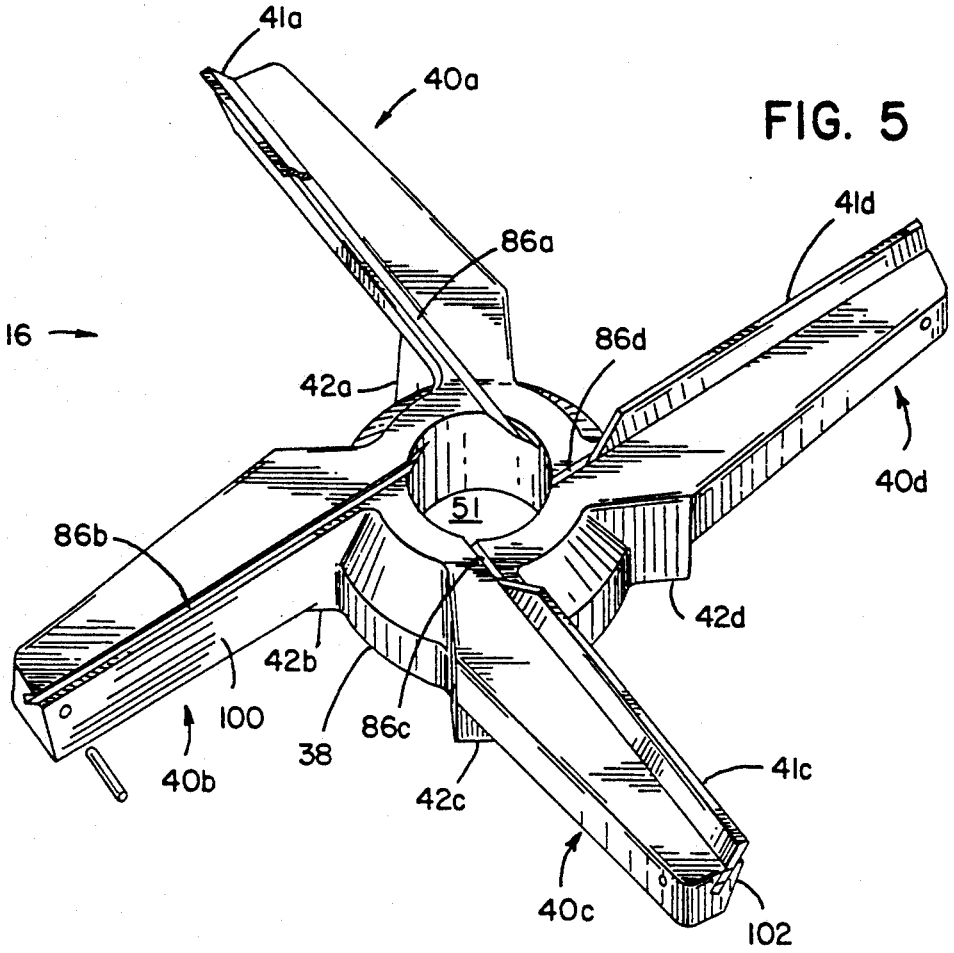
FIG. 5 is an isometric view of the knife holder assembly of FIG. 4.

Referring to FIGS. 1, 4, and 5, rotating knife assembly 16 comprises a knife holder consisting of a central hub portion 38 and a series of knife holding arms 40*a*, 40*b*, 40*c* and 40*d* extending outwardly therefrom. Knives 41*a*, 41*b*, 41*c* and 41*d* are mounted in arms 40*a*–40*d*, respectively. A series of drive lugs, shown at 42*a*, 42*b*, 42*c* and 42*d*, are formed integrally with hub portion 38 and are in alignment with the inner portion of each of arms 40*a*–40*d*, respectively. Referring to FIG. 1, lugs 42*a*–42*d* are adapted for placement in mating recesses, such as shown at 44*a* and 44*c*, formed in the end of feed screw 14. Engagement of drive lugs 42*a*–42*d* with the walls of the mating recesses, such as shown at 44*a*, 44*c*, causes rotation knife assembly 16 in response to rotation of feed screw 14.

A belleville-type spring washer assembly, such as shown at 46, is placed within an annular inner recess 48 formed in the end of feed screw 14 which extends inwardly from the mating recesses, such as 44*a*, 44*c*, also formed in the end of feed screw 14. Spring washer 46 bears between the ends of drive lugs 42*a*–42*d* and the inner end wall of annular recess 48 to bias knife assembly 16 against the inner surface of orifice plate 18.

A centering shaft 49 has its inner end located within a central bore 50 formed in the end of feed screw 14, and its outer end extending through a central passage 51 formed in hub portion 38 of knife assembly 16. A spring 49*a* is located in a bore formed in the inner end of shaft 49, and bears against the inner end of bore 50. The outermost end of centering shaft 49 is received within a central passage 52 provided in a bushing 53. Bushing 53 acts to maintain an adaptor 53*a* in position against the outer surface of orifice plate 18, and includes external threads 54 which engage internal threads 56 formed in a central opening 57 (FIG. 3) formed in orifice plate 18. With this arrangement, bushing 53 and orifice plate 18 cooperate to rotatably support the end of feed screw 14 through centering shaft 49. Centering shaft 49 is keyed to feed screw 14 by means of a key 57′ mounted to shaft 49 and engaged within a slot 57″ associated with bore 50. In this manner, shaft 49 rotates in response to rotation of feed screw 49.

Adaptor plate 53*a* is pinned to orifice plate 18 so as to be non-rotatable relative to orifice plate 18. As shown in FIG. 2, orifice plate 18 is provided with a pin-receiving hole 59, and adaptor plate 53*a* likewise is provided with a facing pin-receiving hole (not shown). A pin, or dowel, is placed within the facing pin-receiving holes in orifice plate 18 and adaptor plate 53*a* to fix adaptor plate 53*a* relative to orifice plate 18.

The mounting of knife assembly 16 to the end of feed screw 14 as shown and described provides adjustability of the clearance between the end of the tapered feed screw pressure flighting, shown at 58, and the inner surface of orifice plate 18 while maintaining the knives of knife assembly 16, such as shown at 41*a* and 41*c* in FIG. 1, against the inner surface of orifice plate 18. To increase the clearance between pressure flighting end 58 and the inner surface of plate 18, mounting ring 20 is turned on housing threads 22 so as to move ring 20 rightwardly. While this takes place, spring washer assembly 46 expands to urge knife assembly 16 rightwardly so as to maintain the knives against the inner surface of plate 18, and thereby maintaining the outer peripheral portion of plate 18 against lip 28 of mounting ring 20. If necessary, additional spring washers can be employed.

To decrease the clearance between pressure flighting end 58 and the inner surface of plate 18, mounting ring 20 is turned on housing threads 22 so as to move ring 20 leftwardly. This action forces spring assembly 46 to compress while maintaining the knives against the inner surface of orifice plate 18.

An annular space 61 (FIG. 1) is located outwardly of the ends of knife arms 40*a*–40*d*. Space 61 allows material to pass to a succeeding knife arm during rotation of knife assembly 16.

Referring to FIG. 4, the arrangement of knife holding arms 40*a*–40*d* relative to hub portion 38 is most clearly illustrated. As shown, arms 40*a*–40*d* are arranged so as to be non-radial relative to hub 38. More particularly, arms 40*a*–40*d* are positioned such that the longitudinal axis of each of arms 40*a*–40*d* is perpendicular to the longitudinal axis of its adjacent arms. In addition, the knives, such as shown at 41*a*, 41*c* and 41*d* as mounted to arms 40*a*, 40*c* and 40*d*, respectively, are also perpendicular to each other.

Arms 40*a*–40*d* each include a base portion such as shown at 62*a*–62*d*, respectively, which is mounted to hub portion 38. Arms 40*a*–40*d* further include outer end portions 64*a*–64*d*, respectively, spaced outwardly from base portions 62*a*–62*d*, respectively.

Knife assembly 16 is adapted for rotation in the direction of an arrow 64, when mounted to the end of feed screw 14.

Referring to arm 40*a* (FIG. 4), the orientation of arm 40*a* relative to a line 66*a* extending between the center of knife assembly 16 and the centroid of base portion 62*a* of arm 40*a* is such that arm 40*a* is oriented in the direction of arrow 64 away from line 66*a*. Each of arms 40*b*–40*d* is similarly oriented relative to lines 66*b*–66*d*, which extend through the center of knife assembly 16 and the centroid of the respective base portions 62*b*–62*d*. With this arrangement, the longitudinal axes of arms 40*a*–40*d* are tangential to a common circle concentric with the center of knife assembly 16.

With the forwardly disposed non-radial arrangement of arms 40*a*–40*d*, material located against the inner surface of orifice plate 18 and engaged by knife arms 40*a*–40*d* is generally swept inwardly toward the center of knife assembly 16 when it is rotated during operation of grinding head 10. A portion of such material may be swept outwardly upon rotation of knife assembly 16. Soft tissue is forced through grinding openings 30 before it reaches the central portion of plate 18. Hard material such as bone, sinew, gristle or the like, which does not readily pass through grinding openings 30, rides on plate 18 over openings 30 and is directed inwardly toward hub portion 38 of knife assembly 16 and the central area of plate 18. Upon continued rotation of knife assembly 16, the hard material is directed to ramped entryways 34 associated with collection openings 32, and is collected in openings 32. With a large piece of hard material which cannot pass into collection openings 32, the piece is lodged within entryway 34 into a collection opening 32 and is forced by knife assembly 16 against shearing surface 36 defined by the end of ramped entryway 34 in combination with the end area of collection opening 32. One of the knives (41*a*–41*d*) engages the piece of hard material, and cooperates with shearing surface 36 to cut the piece of material lodged within entryway 34. The portion of material within entryway 34 is then passed into collection opening 32, while the remainder of the piece of material is directed by the knife assembly into another of entryways 34. The above-described action repeats until the piece of material is reduced to a size small enough to pass in its entirety through one of collection openings 32.

It should be appreciated that knife arms 40*a*–40*d* may alternatively be arranged radially relative to hub portion 38, or arranged non-radially with arms 40*a*–40*d* being angled rearwardly. The specific arrangement of arms 40*a*–40*d* will be determined largely by the type and grade of material being ground. In any case, it has been found that hard material displays a tendency to migrate toward the center upon rotation of the knife assembly. This tendency simply increases when the knife arms are angled forwardly.

Referring to FIGS. 1, 4 and 5, knife assembly 16 includes pockets 68*a*, 68*b*, 68*c* and 68*d* formed in hub portion 38. Pockets 68*a*–68*d* are disposed forward of the forward edges of knife arms 40*a*–40*d*, respectively. Each of pockets 68*a*–68*d* is defined in part by an outwardly facing ramped surface 70*a*–70*d*, respectively. Referring to FIG. 1, the ramped surfaces, such as 70*a*, are located on hub portion 38 so as to intersect a longitudinal axis through each of collection openings 32. The ramped surfaces, such as 70*a*, cooperate with ramped entryways 34 into collection openings 32, to define a passage for directing hard material into ramped entryways 34 and collection openings 32. Pockets 68*a*–68*d* provide a low pressure toward the center of knife assembly 16, for facilitating passage of material inwardly toward the central portion of orifice plate 18 during rotation of knife assembly 16. In this manner, hard material which does not readily pass through grinding openings 30 is directed into ramped entryways 34 and collection openings 32.

Adaptor plate 53*a* is provided with a series of spaced passages therethrough, shown in FIG. 1 at 72*a* and 72*c*. The passages (72*a*, 72*c*) in adaptor plate 53*a* are placed into alignment with collection openings 32 in orifice plate 18, when adaptor plate 53*a* is pinned to plate 18 as described previously.

A collection cup 74 having a collection cavity 76 is mounted to adaptor plate 53*a* by internal threads 78 provided on collection cup 74 engaging external threads 80 formed on bushing 53. A discharge tube 82 extends from the outer end of cup 74, and includes an internal passage adapted to receive material from collection cavity 76. A valve 83 may be provided downstream of discharge tube 82 for controlling the pressure in tube 82 and the rate of discharge of hard material therefrom. Valve 83 is preferably adjustable so that an optimal pressure setting can be attained to ensure that substantially all hard material passes into collection openings 32 while a maximum amount of soft tissue passes through grinding openings 30 before being forced by knife assembly 16 into the central area of orifice plate 18. This pressure may also be controlled by adjusting the amount of engagement between collection cup internal threads 78 and adaptor plate threads 80, and thereby the amount of flow restriction provided by collection cavity 76.

A discharge auger 84 is mounted to the end of centering shaft 49 and is rotatable therewith in response to rotation of feed screw 14, for assisting in discharging the collected hard material from collection cavity 76 of cup 74 and into the internal passage of discharge tube 82. Discharge auger 84 is provided at its inner end with a non-circular hub 84', and a threaded stub shaft extends from hub 84' into engagement with internal threads provided in a bore 85 formed in the outer end of centering shaft 49. A frustoconical collar member 85' is mounted to the end of centering shaft 49 along with discharge auger 84, and is rotatable therewith by engagement of auger hub 84' with the walls of an internal passage formed in collar member 85' in which hub 84' is located. In this manner, collar member 85' is rotatable along with discharge auger 84 in response to rotation of feed screw 14.

The outer walls of collar member 85' are oriented substantially parallel to the inner walls of collection cup 74, so that a tapered annular passageway is formed in collection cavity 76 through which the collected hard material passes into the internal passage of discharge tube 82. Discharge auger 84 assists in moving the collected hard material into and through the internal passage of discharge tube 82, to reduce the back pressure within collection cavity 76 and to facilitate passage of collected hard material through collection openings 32 and the passages, such as 72*a*, 72*c*, formed in adaptor plate 53*a* and into collection cavity 76.

Reference is now made to FIGS. 1 and 5–7 for an explanation of the manner in which knives 41*a*–41*d* are mounted to knife arms 40*a*–40*d*, respectively. As shown in FIG. 5, arms 40*a*–40*d* are provided with knife mounting slots 86*a*–86*d*, respectively. Each of slots 86*a*–86*d* extends throughout the length of its respective knife arm, and opens into central passage 51 provided in hub portion 38 of knife assembly 16. Slots 86*a*–86*d* are slanted relative to the outer faces of knife arms 40*a*–40*d*, respectively, to provide a forward angled orientation of knives 41*a*–41*d* relative to the outer faces of knife arms 40*a*–40*d*, respectively.

Figure 7:
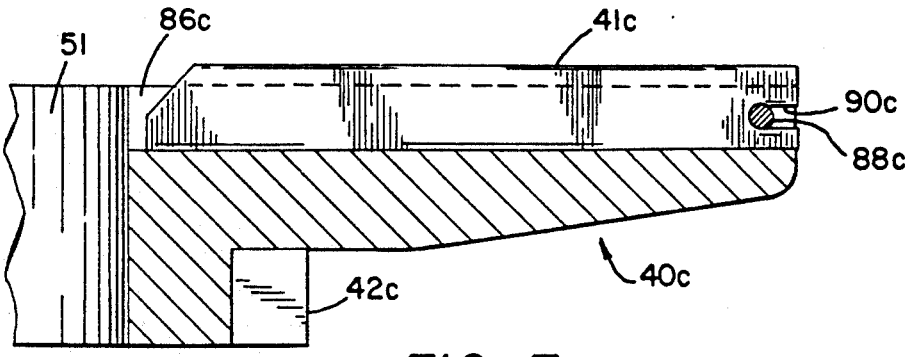
FIG. 7 is a view similar to FIG. 6, showing mounting of a knife in the knife holder assembly of the invention.

Referring to FIG. 7, knife arm 40*c* and knife 41*c* are illustrated. A knife mounting pin 88*c* is provided toward the outer end of knife arm 40*c*, extending transversely through knife mounting slot 86*c*. Knife mounting pin 88*c* is pressed-fit into a transverse opening formed in the outer end of knife arm 40*c*. Knife 41*c* includes an outwardly facing knife mounting slot 90*c* formed in its outer end. Knife 41*c* is mounted to knife arm 40*c* by first inserting the length of knife 41*c* into slot 86*c* so that the outer end of knife 41*c* clears knife mounting pin 88*c*. In this position, a portion of the inner end of knife 41*c* is disposed within passage 54 formed in hub portion 38. Knife 41*c* is then slid rightwardly within knife mounting slot 86*c*, so that pin-receiving slot 90*c* in its outer end receives knife mounting pin 88*c* and pin 88*c* engages the inner end of pin-receiving slot 90*c*. After centering shaft 49 is inserted through passage 51 formed in hub portion 38, leftward movement of knife 41*c* within knife mounting slot 86*c* results in the leftward end of knife 41*c* engaging centering shaft 49 before knife mounting pin 88*c* exits pin-receiving slot 90*c*. In this manner, knife 41*c* is positively retained within knife mounting slot 86*c* of knife arm 40*c*.

Knives 41*a*, 41*b* and 41*d* are retained in knife mounting slot 86*a*, 86*b* and 86*d*, respectively of knife arms 40*a*, 40*b* and 40*d* in a similar manner.

Figure 6:
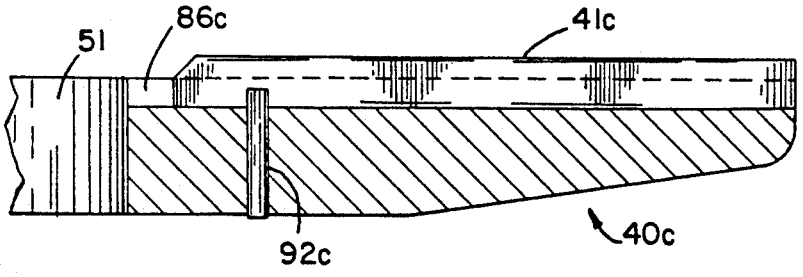
FIG. 6 PRIOR ART
FIG. 6 is a partial sectional view showing prior art mounting of knives in a prior art knife holder assembly.

FIG. 6 illustrates a prior art system of mounting a knife within a knife arm. Like reference characters will be used where possible to facilitate clarity. In the arrangement shown in FIG. 6, knife arm 40*c* again includes a knife mounting slot 86*c* which extends throughout the length of knife arm 40*c* between its outer end and inwardly opening into passage 51. A knife mounting pin 92*c* is press-fit into an opening formed in the rearward portion of knife arm 40*c*, with its forward edge extending into knife mounting slot 86*c*. Knife 41*c* is provided with a notch 94 which receives the end of pin 92*c*. With this arrangement, knife 41*c* is not positively retained within knife mounting slot 86*c*. Rather, pin 92*c* and notch 94 simply cooperate to fix to lateral position of knife 41*c* relative to knife arm 40*c*. With the knife mounting arrangement as illustrated in FIG. 7, providing positive retention of the knives within the knife mounting slots formed in the knife arms, changing of orifice plates is accomplished in a quicker and more efficient manner, in that the operator does not have to be concerned with making sure the knives do not fall out of the knife mounting slots formed in the knife arms. As long as centering shaft 49 remains in place in passage 51 formed in hub portion 38 of knife assembly 16, the knives are positively retained and cannot be removed from the knife mounting slots.

Referring to FIGS. 4 and 5, the forward face of knife arm 40*b* is provided with a forwardly extending ramped surface, shown at 100. While not visible in FIGS. 4 and 5, the forward face of knife arm 40*d* is similarly provided with a forwardly extending ramped surface. As shown in FIG. 5, the forward face of knife arm 40*c* is provided with a rearwardly extending ramped surface 102. Knife arm 40*a*, which is opposite knife arm 40*c*, is similarly provided with a rearwardly extending ramped surface.

When rotating knife assembly 16 is mounted to the end of feed screw 14, knife arms 40*a* and 40*c* are located adjacent the termination of the pressure flights, such as shown in phantom in FIG. 4 at 103*a* and 103*c*, at the end of feed screw 14. Accordingly, arms 40*b* and 40*d* are located at 90° to the pressure flight terminations 103*a*, 103*c*. With this arrangement, the rearwardly (or inwardly) extending ramped surfaces on knife arms 40*a* and 40*d* act to relieve some of the pressure generated by the pressure flight terminations 103*a*, 103*c* during rotation of feed screw 14. The forwardly (or outwardly) extending ramped surfaces, such as surface 100 on the forward face of arm 40*b*, act to generate pressure forcing the material toward the inner surface of orifice plate 18 at arms 40*b*, 40*d* during rotation of feed screw 14. In this manner, the pressure forcing the material toward orifice plate 18 is more evenly distributed between arms 40*a*, 40*d*.

Gaps, such as shown at 104*a* and 104*c* in FIG. 4, are present between pressure flight terminations 103*a*, 103*c* and the forward faces of knife arms 40*a*, 40*c*, respectively. Gaps 104*a*, 104*c* lead to passages, such as shown at 105*a*, 105*c* in FIG. 1, formed between the inner surfaces of the knife arms and the end of feed screw 14. The gaps, such as 104*a* and 104*c*, and the passages, such as 105*a* and 105*c*, cooperate to allow hard material to pass rearwardly from one knife arm to the next during rotation of the knife assembly. This provides further insurance that hard material is not excessively forced against the inner surface of orifice plate 18 before it reaches collection openings 32.

Figure 8:
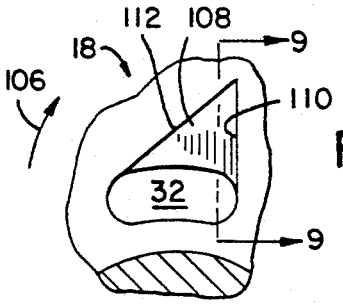
FIG. 8 is an enlarged partial elevation view showing an alternate embodiment for the ramped entryways associated with the collection openings formed in the orifice plate.
Figure 9:
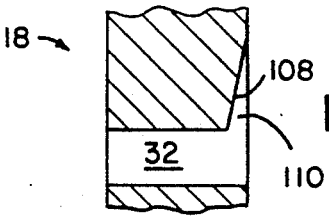
FIG. 9 is a partial sectional view taken generally along line 9—9 of FIG. 8.

FIGS. 8 and 9 illustrate an alternate arrangement for the ramped surfaces leading into collection openings 32 formed in orifice plate 18. In this arrangement, the knife assembly rotates in the direction of an arrow 106. The ramped surface leading into collection opening 32 is shown at 108. Ramped surface 108 extends outwardly toward the outer grinding orifices 30 formed in orifice plate 18, tapering upwardly and outwardly from collection opening 32. Ramped surface 108 terminates at its rightward end in a shearing edge 110, which is substantially triangular in shape. Ramped surface 108 intersects the inner surface of orifice plate 18 at a line shown at 112, which extends between the outer end of shearing edge 110 and the leftward end of collection opening 32. This arrangement acts to force the hard material downwardly on ramped surface 108 toward collection opening 32 and shearing edge 110, so that a maximum amount of area of shearing edge 110 is available for acting on the hard material along with the knives to shear the hard material off and to facilitate its passage into collection openings 32. Ramped surface 108 is substantially in the form of a right triangle defined between shearing edge 110, the outer wall of collection opening 32, and line of intersection 112.

Ramped surface 108 has a depth of approximately $\frac{1}{8}$ inch at the outer wall of collection opening 32, and is inclined relative to the inner surface of orifice plate 18 at an angle of approximately 8.5°.

With some types of material being ground, a situation sometimes arises in which a substantial amount of usable soft tissue passes through collection openings 32 along with the hard material. In such situations, it is desirable to recover the usable soft material in order to reduce the amount of wasted usable material. FIGS. 10–13 illustrate two arrangements for recovering usable material which passes through collection openings 32.

Figure 10:
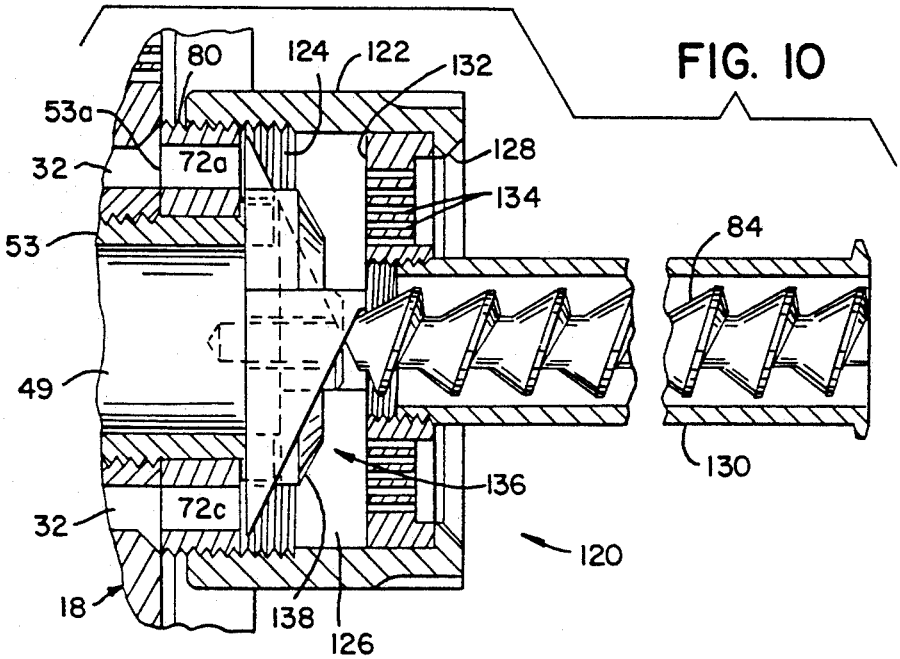
FIG. 10 is a partial sectional view showing one embodiment of a recovery grinder arrangement for grinding of soft material which passes through the collection openings formed in the orifice plate.

Referring to FIG. 10, a recovery grinding arrangement 120 generally includes a cylindrical housing member 122 having internal threads 124 for engaging external threads 80 provided on adaptor plate 53*a*. Housing 122 defines an internal collection cavity 126, and an opening 128 is provided at the outer end of housing member 122.

In the same manner as described previously with respect to FIG. 1, a discharge auger 84 is mounted to the end of centering pin 49 and is rotatable therewith in response to rotation of feed screw 14. Discharge auger 84 is located within a discharge passage formed in a discharge tube 130, which is threadedly engaged with a central passage formed in a secondary orifice plate, shown at 132. As with orifice plate 18, secondary orifice plate 132 is provided with a series of discharge orifices 134, which may be somewhat smaller in diameter than orifices 30 formed in primary orifice plate 18.

Secondary orifice plate 132 engages an inwardly extending lip which forms opening 128 in the outer end of housing 122.

Figure 11:
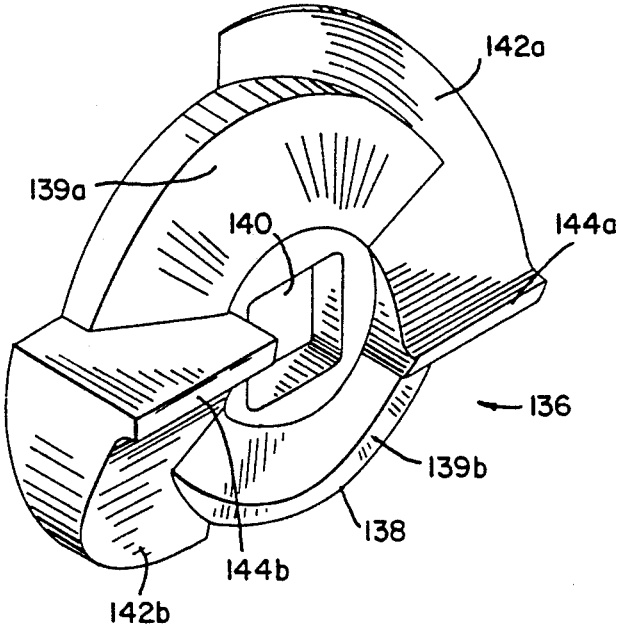
FIG. 11 is an isometric view showing the rotating recovery knife assembly provided in the recovery grinding arrangement of FIG. 10.

A recovery knife assembly 136, shown in FIGS. 10 and 11, is located between the end of centering shaft 49 and the inner surface of secondary orifice plate 132. Recovery knife assembly 136 generally comprises a disk-like body portion 138 having a square aperture 140 formed therein. The hub of discharge auger 84 is placed within aperture 140, so that recovery knife assembly 136 is rotatable in response to rotation of centering shaft 49 and feed screw 14. Body portion 138 includes a pair of beveled surfaces 139*a*, 139*b*.

Spring 49*a* (FIG. 1) urges recovery knife assembly 136 against the inner surface of secondary orifice plate 132.

Recovery knife assembly 136 further includes a pair of angled flights 142*a*, 142*b*, which terminate in a pair of knife tips 144*a*, 144*b*, respectively. Material passing through the passages, such as 72*a*, 72*c*, formed in adaptor plate 53*a*, is picked up by flights 142*a*. 142*b* and fed thereon toward knife tips 144*a*, 144*b* and toward the inner surface of secondary orifice plate 132. The hard material migrates along beveled surfaces 139*a*, 139*b* toward the center of recovery knife assembly 136 and into the inlet of the internal passage provided in discharge tube 130. The soft material migrates outwardly toward orifices 134 formed in orifice plate 132, and is forced therethrough by pressure generated by flights 142*a*, 142*b* upon rotation of recover knife assembly 136.

The ground soft material which is discharged through orifices 134 in secondary orifice plate 132 mixes with the ground soft material discharged from the orifices formed in primary orifice plate 18, and thereby is incorporated into the final ground product.

As in the embodiment of FIG. 1, discharge auger 84 acts to move the collected hard material through the passage of discharge tube 130, for ultimate collection in a receptacle (not shown). A valve, such as 83 in FIG. 1, may be provided downstream of the discharge of discharge tube 130 for regulating the amount of pressure within discharge tube 130 and collection cavity 126. In this manner, an optimal operating condition can be attained so as to recover a maximum amount of soft material through secondary orifice plate 132 while removing substantially all hard material from the final ground product.

Figure 12:
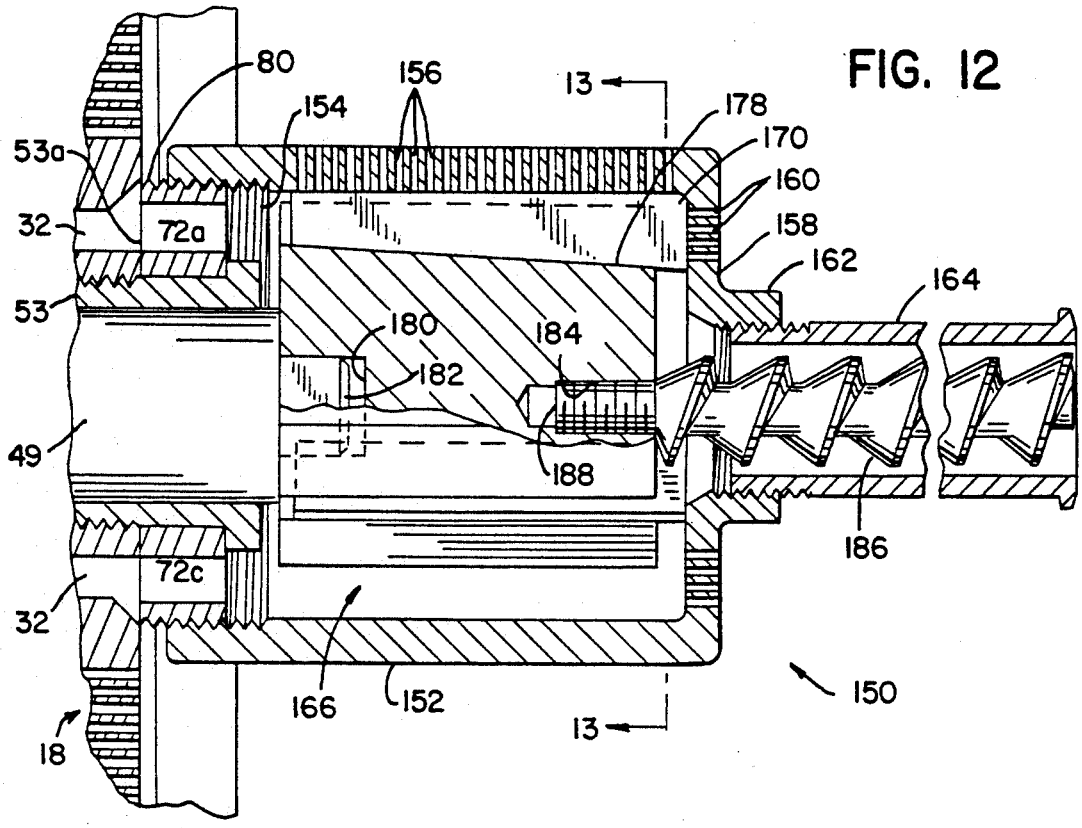
FIG. 12 is a view similar to FIG. 10, showing an alternative embodiment for providing recovery grinding of soft material.
Figure 13:
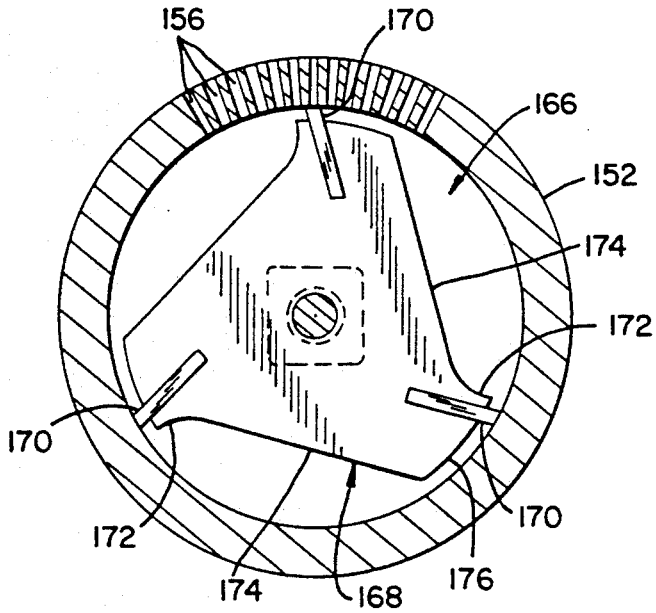
FIG. 13 is a sectional view taken generally along line 13—13 of FIG. 12.

FIG. 12 illustrates a recovery grinding arrangement 150. In this arrangement, a cylindrical housing 152 is provided with internal threads 154 which engage external threads 80 on adaptor plate 53*a*. Housing 152 is provided with a series of relatively small upwardly facing orifices 156 extending through the upper portion of its side wall. Orifices 156 are formed in the wall of housing 152 throughout an arc ranging between 60° and 120°. As shown in FIG. 13, the arc encompassing orifices 156 is approximately 60°. Housing 152 includes an end wall 158 which partially closes its end opposite the open end in which internal threads 154 are formed. An annular ring of relatively small orifices 160 is formed in end wall 158. An internally threaded nipple 162 is provided in end wall 158, and a discharge tube 164 having external threads at one of its ends is adapted for connection to nipple 162. With this arrangement, the internal discharge passage of discharge tube 164 is placed into communication with the interior of cylindrical housing 152.

A rotating recovery knife assembly 166 is disposed within the interior of housing 152. Knife assembly 166 includes a knife holding member 168 having three equally radially spaced axially extending lobes provided with outwardly facing slots in which knives 170 are mounted. Each lobe is formed by a substantially radial front surface 172 which merges into a leading surface 174 in a direction toward the preceding lobe. Each lobe further includes an outer surface 176 located inwardly of the inner wall of housing 152, and extending between the front surface 172 and the leading surface 174 of the succeeding lobe.

The slot formed in each lobe angles inwardly toward the center of knife holding member 168 in a direction toward end wall 158, such as illustrated by slot 178 in FIG. 12. Each knife 170 is provided with an inner surface having an angle adapted to mate with the angled inner surface of the slots, so as to maintain the outer edge of each knife 170 in contact with the inner surface of housing 152 throughout the length of knife 170. In addition, knives 170 have a height at their outer ends which extends throughout the thickness of the annular ring of orifices 160 formed in end wall 158. The end of knives 170 is in contact with the inner surface of end wall 158 throughout the width of the ring of orifices 160.

As in the FIG. 10 embodiment, spring 49*a* (FIG. 1) urges recovery knife assembly 166 against end wall 158 of housing 152.

Knife holding member 168 is provided at its inner end with a square recess 180 facing the outer end of centering shaft 49. Centering shaft 49 is provided with a square projection 182 which mates with the side walls of square recess 180, so as to impart rotation to knife holding member 168 in response to rotation of centering shaft 49 caused by rotation of feed screw 14.

The outer end of knife holding member 168 is provided with an internally threaded bore 184. A discharge auger 186 has an externally threaded stub shaft 188, which is engageable with threaded bore 184 to secure discharge auger 186 to knife holding member 168. With this arrangement, rotation of knife holding member 168 causes rotation of discharge auger 186, to advance hard material through the discharge passage of discharge tube 164.

In operation, the embodiment of FIG. 12 functions as follows. In a manner as described above, hard material is routed through collection openings 32 in orifice plate 18 to the discharge passages in adaptor plate 53*a*, such as shown at 72*a* and 72*c*, and into the interior of cylindrical housing 152. A certain amount of usable soft material is included with the hard material, and the soft material migrates outwardly toward the inner wall of housing 152, while the hard material migrates inwardly. The usable soft material is forced upwardly through orifices 156 in housing 152, and is severed by knives 170. In a similar manner, the soft material is forced outwardly through the ring of orifices 160 formed in end wall 158, and is severed by the ends of knives 170. The discharged soft material passing through orifices 156 and 160 is mixed with the ground soft material discharged from the upper portion of primary orifice plate 18, flowing downwardly along the sides of housing 152 into a hopper or the like. The hard material is routed along leading surfaces 174 of knife holding member 168 toward its outer end, and from there passes into the opening of nipple 162 and the discharge passage of discharge tube 164. Discharge auger 186 moves the hard material through discharge tube 164, thus creating a low pressure area at the entrance into nipple 162 to facilitate drawing the hard material thereinto.

In an alternate embodiment, the annular ring of small orifices 160 formed in end wall 158 can be eliminated, thus providing only radial upward flow of the recovered material through orifices 156 formed in housing 152.

While the invention as shown and described provides several features which enhance the ability of grinding head 10 to collect hard material during operation, it is understood that certain of the described features could be employed without other of the described features to yield improved hard material collection. For example, an orifice plate 18 constructed according to the invention could be employed with a prior art knife assembly, and would result in improved ability to collect hard material due to the advantages offered by ramped entryways 34 leading into collection openings 32. Knife assembly 16 as shown and described could be employed with a prior art orifice plate which does not include ramped entryways, and would result in improved hard material collection due to advantages in directing material inwardly offered by the construction of knife assembly 16. Recovery grinding arrangement 120 and 150 could be employed with a prior art grinding and hard material collection system, to provide recovery grinding of usable soft material which is collected along with the hard material. To most effectively collect hard material and recover usable material, however, the features as described are combined into a single structure.

The advantages offered by the invention in collecting hard material and recovering collected soft material allows an operator to use a lower grade of meat to be ground which typically includes a greater amount of hard material than does a higher grade of meat. Accordingly, the operator can reduce the cost of producing ground meat by employing a lower grade of material, while yielding a final ground meat product which is comparable in quality to that attained with use of a higher grade raw material in a prior art system.

The adjustability feature described previously, in which the clearance provided between the inner surface of orifice plate 18 and the end 58 of the pressure flighting, allows the operator to adjust grinding head 10 according to the hard material conditions in the meat being ground. For a lower grade of meat, which may contain large pieces of hard material, the clearance between the inner surface of orifice plate 18 and pressure flighting end 54 is increased. This allows the large pieces of material to ride on the inner surface of orifice plate 18 without being repeatedly subjected to pressure exerted by pressure flighting end 54, which otherwise may cause the piece of material to chip against grinding orifices 30. In this manner, the large piece of material is directed inwardly toward collection orifices 32 without being repeatedly subjected to exertion of pressure, and is reduced in size as described previously for ultimate passage through collection openings 32. When a higher grade of meat is being ground, and which contains smaller pieces of hard material, the clearance between the inner surface of orifice plate 18 and pressure flighting end 54 is decreased. In all situations, however, knife assembly 16 is urged against the inner surface of orifice plate 18 by spring washer assembly 46.

Various alternatives and embodiments are contemplated as being within the scope of the following claims, particularly pointing out and distinctly claiming the subject matter regarded as the invention.

I claim:

1. A method of grinding material such as meat, comprising the steps of:

mounting a primary orifice plate in the open end of a housing, with a rotating knife assembly being located within the housing adjacent the primary orifice plate;

advancing the material through the housing toward the primary orifice plate while rotating the knife assembly, to grind the material by severing the material prior to passage of the material through the orifices formed in the primary orifice plate;

routing hard material contained within the material toward collection openings formed in the primary orifice plate by operation of the rotating knife assembly and discharging the collected hard material through the collection openings; and mounting a recovery grinding structure downstream of the primary orifice plate for providing recovery grinding of soft material passing through the collection openings along with the hard material, and for discharging the collected hard material therefrom after recovery of the soft material.

2. A grinder for grinding material, comprising:

a housing having an inlet and an outlet;

an orifice plate located at the housing outlet and defining a first surface;

advancing means for moving material through the housing toward the orifice plate;

a rotating knife assembly located adjacent the first surface of the orifice plate;

a series of spaced collection passages located toward the center of the orifice plate for collecting hard material contained with the material being ground; and a series of individual entryways formed in the first surface of the orifice plate, wherein each entryway leads directly into one of the collection passages from the first surface of the orifice plate.

3. The grinder of claim 2, wherein at least one end of each entryway cooperates with the first surface of the orifice plate to define a shearing surface at the intersection of the end of the entryway with the first surface of the orifice plate, the shearing surface being disposed substantially perpendicular to the first surface of the orifice plate.

4. The grinder of claim 3, wherein the shearing surface is substantially aligned with an end of the collection passage.

5. The grinder of claim 1, wherein the orifice plate includes a plurality of outer relatively small grinding openings through which the material passes, and wherein the collection passages are located inwardly of the outer openings.

6. The grinder of claim 5, wherein the entryway associated with each collection passage comprises a ramped surface extending from the collection passage outwardly toward the outer openings.

7. The grinder of claim 6, wherein the orifice plate further defines a second surface spaced from the first surface, and wherein a ramped entryway is formed on both the first and second surfaces of the orifice plate at each collection passage for allowing the orifice plate to be mounted such that either surface of the orifice plate faces the knife assembly.

8. The grinder of claim 5, wherein the ramped surface extending from the collection passage outwardly toward the outer openings comprises a substantially triangular ramped surface formed in the orifice plate, wherein:

a first side of the triangular surface defines a shearing surface disposed substantially perpendicular to the surface of the orifice plate;

a second side of the triangular ramped surface comprises an edge of the collection passage; and a third side of the triangular ramped entryway comprises a line of intersection between the ramped surface and the surface of the orifice plate.

9. The grinder of claim 2, wherein the knife assembly comprises a central hub, a plurality of knife holding arms extending outwardly from the hub, and a knife mounted to each knife holding arm, wherein the knife holding arms and the knives are arranged such that each knife passes over each ramped entryway formed in the orifice plate during rotation of the knife assembly and wherein the hub includes a collection pocket defining an outwardly facing ramped area facing the orifice plate between each arm.

10. The grinder of claim 9, wherein the outwardly facing ramped areas in the hub intersect a longitudinal axis of each collection passage during rotation of the knife assembly.

11. The grinder of claim 1, wherein the knife assembly comprises a central hub, a plurality of knife holding arms extending outwardly from the hub, and a knife mounted to each knife holding arm, and wherein the arms are arranged so as to be non-radial relative to the hub.

12. The grinder of claim 11, wherein each arm includes a base connected to the hub and an outer end spaced outwardly from the base, and wherein each arm is arranged such that the longitudinal axis of each arm is non-parallel to a line extending through the base and the center of the hub, and is oriented such that the outer end of each arm is disposed in the direction of rotation of the knife assembly relative to said line.

13. The grinder of claim 11, wherein the arms are arranged such that the longitudinal axis of each arm is tangential to a circle concentric with the center of the hub.

14. The grinder of claim 11, wherein the arms and the knives are arranged such that each arm and knife is substantially perpendicular to the adjacent arms and knives.

15. A grinder, comprising:

a housing having an inlet and an outlet;

an orifice plate located at the housing outlet and defining a first surface;

advancing means for moving material through the housing toward the orifice plate; and a rotating knife assembly located adjacent the first surface of the orifice plate, and including a central hub, a plurality of knife holding arms extending outwardly from the hub, and a knife mounted to each knife holding arm, and wherein the arms are arranged so as to be non-radial relative to the hub and are angled forwardly in the direction of rotation of the knife assembly relative to the hub;

wherein the orifice plate includes a plurality of relatively small outer orifices and a series of spaced apart relatively large inner collection passages for collecting hard material, and wherein the non-radial arrangement of the knife holding arms moves hard material inwardly toward the collection passages during rotation of the knife assembly, and wherein a series of ramped entryways are formed in the first surface of the orifice plate, wherein each ramped entryway opens directly into one of the collection passages from the first surface of the orifice plate and extends outwardly from the collecting passage toward the outer openings for facilitating collection of hard material within the collection passages.

16. The grinder of claim 15, wherein the advancing means comprises a feed screw, and further comprising drive means interposed between the end of the feed screw and the knife assembly for rotating the knife assembly in response to rotation of the feed screw.

17. The grinder of claim 16, wherein the drive means comprises a plurality of drive lugs mounted to the rear portion of the knife assembly, with the end of the feed screw including recesses adapted to receive the drive lugs, whereby the knife assembly is drivingly engaged with the feed screw when the drive lugs are received within the recesses.

18. The grinder of claim 17, wherein the drive lugs extend rearwardly from the hub, with each drive lug being located rearwardly of one of the knife holding arms.

19. A grinder, comprising:

a housing having an inlet and an outlet;

an orifice plate located at the housing outlet;

advancing means for moving material through the housing toward the orifice plate;

a rotating knife assembly located adjacent a surface of the orifice plate, and including a central hub, a plurality of knife holding arms extending outwardly from the hub, and a knife mounted to each knife holding arm, and wherein the arms are arranged so as to be non-radial relative to the hub and are angled forwardly in the direction of rotation of the knife assembly relative to the hub;

wherein the orifice plate includes a plurality of relatively small outer orifices and a series of spaced apart relatively large inner collection passages for collecting hard material, and wherein the non-radial arrangement of the knife holding arms moves hard material inwardly toward the collection passages during rotation of the knife assembly, and wherein each collection passage includes a ramped entryway opening onto a surface of the orifice plate and extending outwardly from the passage toward the outer openings for facilitating collection of hard material within the collection passages; and a collection pocket formed on the hub forwardly of each knife holding arm and facing the orifice plate, for receiving hard material moved inwardly during rotation of the knife assembly and facilitating entry of hard material into the collection passages.

20. The grinder of claim 19, wherein each collection pocket includes an outwardly facing ramped area provided on the hub forwardly of each knife holding arm, and wherein a longitudinal axis of each collection passage intersects each outwardly facing ramped area provided on the hub during rotation of the knife assembly.

21. A grinder, comprising:

a housing having an inlet and an outlet;

an orifice plate located at the housing outlet;

advancing means for moving meat through the housing toward the orifice plate;

a shaft mounted to an extending from the advancing means;

a rotating knife assembly located adjacent a surface of the orifice plate, and including a central hub, a plurality of knife holding arms extending outwardly from the hub, and a knife mounted to each knife holding arm, and wherein the arms are arranged so as to be non-radial relative to the hub;

a series of spaced collection passages located toward the center of the orifice plate for collecting hard material, each collection passage including a ramped entryway opening onto the surface of the orifice plate facing the knife assembly;

a substantially central passage formed in the hub for receiving the shaft therethrough;

each knife holding arm having a forwardly opening slot formed therein, with each slot opening into the substantially central passage and being oriented such that the longitudinal axis of each slot is substantially perpendicular to the longitudinal axis of the central passage;

a knife mounting pin extending transversely through each slot toward the outer end of each knife holding arm; and a knife mounted in each slot, each knife including an outwardly opening pin-receiving slot for receiving the knife mounting pin, wherein the shaft and the knife mounting pin cooperate to maintain the knife in position within the slot.

22. A grinder comprising:

a housing having an inlet and an outlet;

an orifice plate located at the housing outlet;

advancing means for moving material through the housing toward the orifice plate;

a knife assembly located adjacent a surface of the orifice plate;

a hard material collection arrangement for collecting hard material contained within the material being ground and for passing the hard material through the orifice plate; and a recovery grinding assembly into which the hard material is discharged from the orifice plate, for grinding usable soft material which passes through the hard material collection arrangement along with the hard material, the recovery grinding assembly including an outlet for discharging hard material therefrom.

23. A grinder for grinding material, comprising:

a housing having an inlet and an outlet;

an orifice plate located at the housing outlet and defining a first surface;

advancing means for moving material through the housing toward the orifice plate;

a series of spaced collection passages located toward the center of the orifice plate for collecting hard material contained within the material being ground;

a series of individual entryways formed in the first surface of the orifice plate, wherein each entryway leads directly into one of the collection passages from the first surface of the orifice plate, each entryway defining a shearing surface intersecting the first surface of the orifice plate; and a rotating knife assembly located adjacent the first surface of the orifice plate, the knife assembly including at least one knife member mounted to the knife assembly such that at least a portion of the knife member passes over the spaced collection passages upon rotation of the knife assembly, to cooperate with the shearing surface defined by the entryway associated with each collection passage to shear hard material disposed within the entryway during rotation of the knife assembly.

24. A grinder for grinding material, comprising:

a housing having an inlet and an outlet;

an orifice plate located at the housing outlet;

advancing means for moving material through the housing toward the orifice plate; and a rotatable knife assembly located adjacent the inner surface of the orifice plate within the housing, the knife assembly comprising a plurality of knife holding arms with a knife mounted to each arm, wherein a first one of the knife holding arms is constructed so as to provide a forwardly extending lead surface which assists in moving the material toward the orifice plate adjacent the knife which is mounted to the knife holding arm upon rotation of the knife assembly;

wherein the advancing means comprises a feed screw having pressure flighting which terminates at the end thereof to which the knife assembly is mounted, and wherein the first knife holding arm is located out of alignment with the pressure flighting end such that the forwardly extending leading surface of the knife holding arm functions to apply pressure to the material toward the orifice plate;

wherein a second one of the knife holding arms is located substantially in alignment with the pressure flighting end, and wherein the second knife holding arm so located is constructed so as to provide a rearwardly extending ramped surface for reducing pressure on the material generated by the pressure flight end.

25. The grinder of claim 24, wherein the knife holding arms extend outwardly from a hub, and wherein the arms are oriented so as to be non-radial relative to the hub and are angularly oriented forwardly in the direction of rotation of the knife assembly relative to a line extending from the center of the hub through the point of connection of the knife holding arm to the hub.

26. A grinder for grinding material comprising:

a housing having an inlet and an outlet;

an orifice plate located at the housing outlet;

advancing means for moving material through the housing toward the orifice plate;

a rotating knife assembly located adjacent a surface of the orifice plate;

a series of spaced collection passages associated with the orifice plate for collecting hard material contained within the material being ground; and a recovery grinding assembly for receiving the hard material from the collection passages and for grinding usable soft material which passes through the collection passages along with the hard material, the recovery grinding assembly including an outlet for discharging hard material therefrom.

27. The grinder of claim 26, wherein the series of spaced collection passages are formed in the orifice plate toward the center of the orifice plate, and wherein the recovery grinding assembly comprises:

a second housing mounted to the orifice plate and having an internal cavity for receiving hard material from the collection passages;

a series of recovery grinding orifices associated with the second housing; and a rotating recovery knife assembly located within the second housing cavity and including at least one knife member arranged so as to pass over the recovery orifices, to provide grinding of soft material prior to output of the soft material through the recovery orifices.

28. The grinder of claim 27, wherein the advancing means for moving material through the housing toward the orifice plate comprises a rotatable feed screw, and wherein the recovery knife assembly is connected to the feed screw so as to be rotatable therewith.

29. The grinder of claim 27, further comprising a discharge tube connected to the recovery grinding assembly for receiving hard material discharged therefrom through the housing outlet, and further comprising a discharge auger disposed within the discharge tube and rotatable in response to rotation of the recovery knife assembly, for advancing the discharged hard material through the discharge tube.

30. The grinder of claim 27, wherein the recovery grinding assembly includes a secondary orifice plate oriented parallel to the first-mentioned orifice plate and located downstream therefrom, for providing axial flow of recovered material therethrough.

31. The grinder of claim 30, wherein the recovery knife assembly includes at least one knife member located against the inner surface of the secondary orifice plate for severing recovered material prior to passage of the recovered material through the secondary orifice plate.

32. The grinder of claim 31, further comprising inclined flighting located forwardly of each knife member for urging soft material toward the inner surface of the orifice plate upon rotation of the recovery knife assembly.

33. The grinder of claim 27, wherein the housing comprises a cylindrical member having a series of recovery orifices formed in an upwardly facing wall thereof extending between the inner surface and the outer surface of a wall of the housing, and wherein the recovery knife assembly includes at least one knife member disposed against the inner surface of the housing wall for severing material prior to passage of the material through the recovery orifices.

34. The grinder of claim 33, further comprising an end wall enclosing at least a portion of the cylindrical housing, and further comprising a ring of recovery orifices formed in the end wall for providing grinding of recovered material therethrough, and wherein the recovery knife assembly includes a knife surface disposed against the inner surface of the end wall adjacent the recovery orifices formed therein.

35. The grinder of claim 33, wherein the recovery knife assembly includes a series of axially extending lobes having outer surfaces facing the inner wall of the cylindrical housing in which knife members are mounted, with the lobes extending parallel to the axis of rotation of the recovery knife assembly, with recessed areas being located between the lobes for allowing passage of hard material along the rotating knife assembly through the cylindrical housing.

36. A grinder, comprising:

a housing having an inlet and an outlet;

an orifice plate located at the housing outlet and defining a central opening;

a rotatable feed screw for moving material through the housing toward the orifice plate;

a centering pin extending from the feed screw through the central opening in the orifice plate;

a rotating knife assembly located adjacent a surface of the orifice plate, and including a central hub, a plurality of knife holding arms extending outwardly from the hub, and a knife mounted to each knife holding arm, each knife defining an inner end and an outer end, wherein each knife holding arm includes a slot in which a knife is mounted, with the slot opening toward the orifice plate, and further comprising a knife mounting pin extending transversely through the slot toward the outer end of the knife holding arm, and a pin-receiving slot formed in the knife extending inwardly from the outer end of the knife for receiving the pin therein, to mount the knife to the knife holding arm, wherein the centering pin engages the inner end of the knife to prevent disengagement of the knife mounting pin from the pin-receiving slot to retain the knife within the slot in the knife holding arm.

37. A knife holder, comprising a central hub and a plurality of knife holding arms extending outwardly from the hub, wherein each arm defines a forward surface and a rearward surface adjacent the hub, and wherein the arms are arranged so as to be non-radial relative to the hub, and further comprising mounting structure associated with each knife holding arm adapted to mount a knife thereto, and a collection pocket formed on the hub and located between the forward surface of each knife holding arm and the rearward surface of the adjacent knife holding arm, wherein each collection pocket is defined in part by an outwardly facing ramped surface formed on the hub and extending substantially entirely between the forward surface of each knife holding arm and the rearward surface of the adjacent knife holding arm.

38. A knife holder for mounting to a screw-type grinder including a centering pin, comprising a central hub and a plurality of knife holding arms extending outwardly from the hub, and further comprising mounting structure associated with each knife holding arm adapted to mount a knife thereto, wherein the mounting structure associated with each knife holding arm comprises a forwardly opening slot formed in each knife holding arm adapted to receive a knife therein, wherein the hub includes a substantially central passage for receiving the centering pin, and wherein the slot in each knife holding arm opens into the central passage, and further comprising a knife mounting pin extending transversely through the slot in each knife holding arm located toward the outer end of each knife holding arm for being received within a pin-receiving opening formed in a knife, to cooperate with the centering pin to maintain a knife in position within the slot.

39. A knife assembly for a grinder including a shaft, comprising:

a knife holder including a hub and a plurality of knife holding arms extending outwardly therefrom;

a substantially central passage formed in the hub for receiving the grinder shaft therethrough;

each knife holding arm having a forwardly opening slot formed therein, with each slot opening into the substantially central passage and being oriented such that the longitudinal axis of each slot is substantially perpendicular to the longitudinal axis of the central passage;

a knife mounting pin extending transversely through each slot toward the outer end of each knife holding arm; and a knife mounted in each slot, each knife including an outwardly opening pin-receiving slot for receiving the knife mounting pin, wherein the shaft and the knife mounting pin cooperate to maintain the knife in position within the slot.

40. The knife assembly of claim 39, wherein the knife holding arms are arranged so as to be non-radial relative to the hub.

41. The knife assembly of claim 39, further comprising a collection pocket associated with the hub and located between the forward surface of each knife holding arm and the rearward surface of its adjacent knife holding arm, wherein each collection pocket is defined in part by an outwardly facing ramped surface provided on the hub.

42. An orifice plate for use in a grinder for grinding material, comprising:

a plate member defining a first surface;

a series of relatively small outer grinding orifices extending through the plate member;

a series of spaced collection passages formed in the plate member located inwardly of the grinding orifices toward the center of the plate member; and a series of individual entryways formed in the first surface of the plate member, wherein each entryway leads directly into one of the collection passages from the first surface of the plate member.

43. The orifice plate of claim 42, wherein at least one end of each entryway cooperates with the first surface of the plate member to define a shearing surface at the intersection of the end of the entryway with the first surface of the plate member, the shearing surface being disposed substantially perpendicular to the first surface of the plate member.

44. The orifice plate of claim 43, wherein the shearing surface is substantially aligned with an end of the collection passage.

45. The orifice plate of claim 44, wherein the shearing surface extends outwardly from one end of the collection passage, and wherein the entryway upstream of the shearing surface tapers upwardly toward the surface of the plate member in a direction toward the other end of the collection opening.

46. The orifice plate of claim 42, wherein the collection passages are radially spaced from each other and are located such that each is at an equal distance from the center of the plate member.

47. The orifice plate of claim 46, wherein each entryway comprises a ramped surface extending outwardly from one of the collection passages toward the outer orifices.

48. The orifice plate of claim 42, wherein each collection passage has an entryway opening onto the first surface of the orifice plate and an entryway opening onto a second surface of the orifice plate opposite said first surface.

* * * * *

UNITED STATES PATENT AND TRADEMARK OFFICE

CERTIFICATE OF CORRECTION

PATENT NO. : 5,251,829

DATED : October 12, 1993

INVENTOR(S) : NICK J. LESAR

It is certified that error appears in the above-identified patent and that said Letters Patent is hereby corrected as shown below:

Claim 5, col. 14, line 40, delete "1" and substitute therefor -- 2 --; Claim 8, col. 14, line 56, delete "5" and substitute therefor -- 6 --; Claim 11, col. 15, line 15, delete "1" and substitute therefor -- 2 --; Claim 24, col. 18, line 4, delete "lead" and substitute therefor -- leading --.

Signed and Sealed this

Twenty-third Day of May, 1995

Bruce Lehman

*Attest:*

BRUCE LEHMAN

*Attesting Officer*

*Commissioner of Patents and Trademarks*